United States Patent [19]

Oganesyan

[11] Patent Number: 5,003,678

[45] Date of Patent: Apr. 2, 1991

[54] METHOD OF MAKING A CHANNEL SET RING

[76] Inventor: Suren Oganesyan, 938 Mountain St., Glendale, Calif. 91207

[21] Appl. No.: 468,075

[22] Filed: Jan. 22, 1990

[51] Int. Cl.[5] ..... B23P 5/00

[52] U.S. Cl. ..... 29/10; 29/160.6; 63/15; 63/26

[58] Field of Search ..... 29/10, 160.6, 418; 63/15, 26, 27, 28

[56] References Cited

U.S. PATENT DOCUMENTS 1,501,616 7/1924 Ogush ..... 29/10

4,566,294 1/1986 Breozowski ..... 29/10

4,936,115 6/1990 Mesica ..... 63/28

*Primary Examiner*—P. W. Echols

*Attorney, Agent, or Firm*—Donald Diamond

[57] ABSTRACT

A channel set ring is provided with a plurality of substantially equidistantly spaced depressions formed in the bottom of a U-shaped groove. Setting holes are formed centrally in each of the plurality of depressions. Once the gems to be set are placed with their pavilions in the setting holes, a piece of tape is used to hold the gems in place while the ring is rotated on a lathe. The upstanding rims formed by the groove are turned with a roller while the ring is rotated on the lathe. After turning the rims, the tape is removed.

7 Claims, 2 Drawing Sheets

FIG. 1
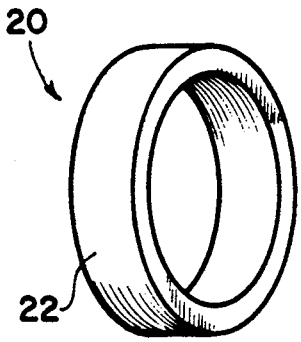
FIG. 2
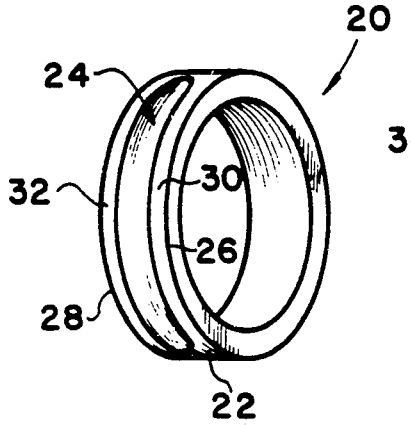
FIG. 3A
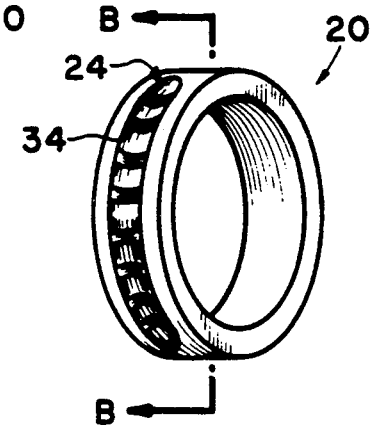
FIG. 3B
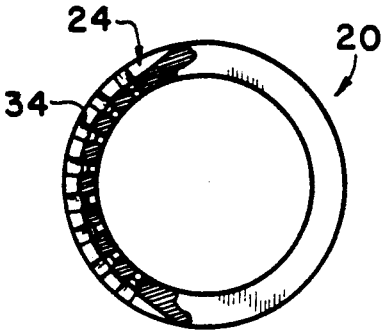
FIG. 3C
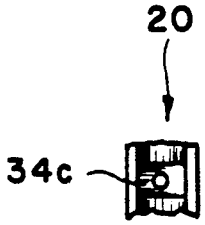
FIG. 4
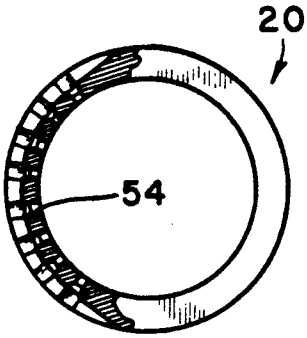
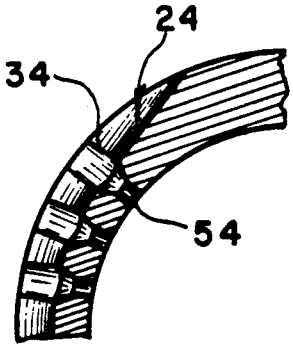
FIG. 5
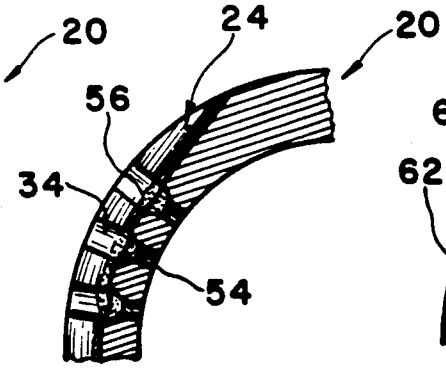
FIG. 6
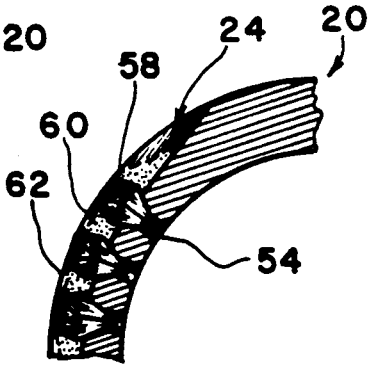
FIG. 7
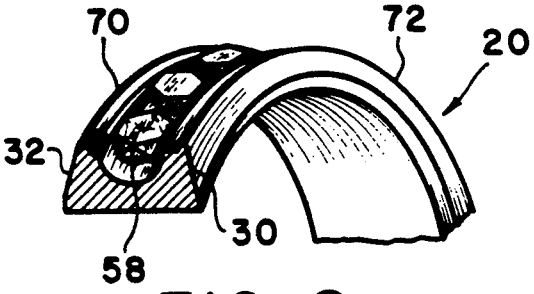
FIG. 8
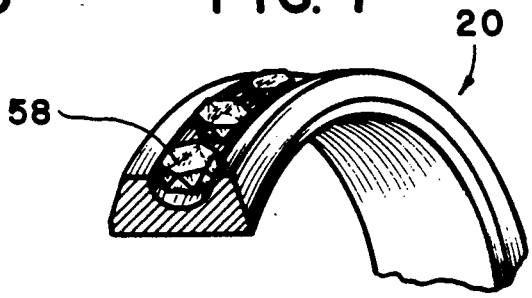
FIG. 9

FIG. 10
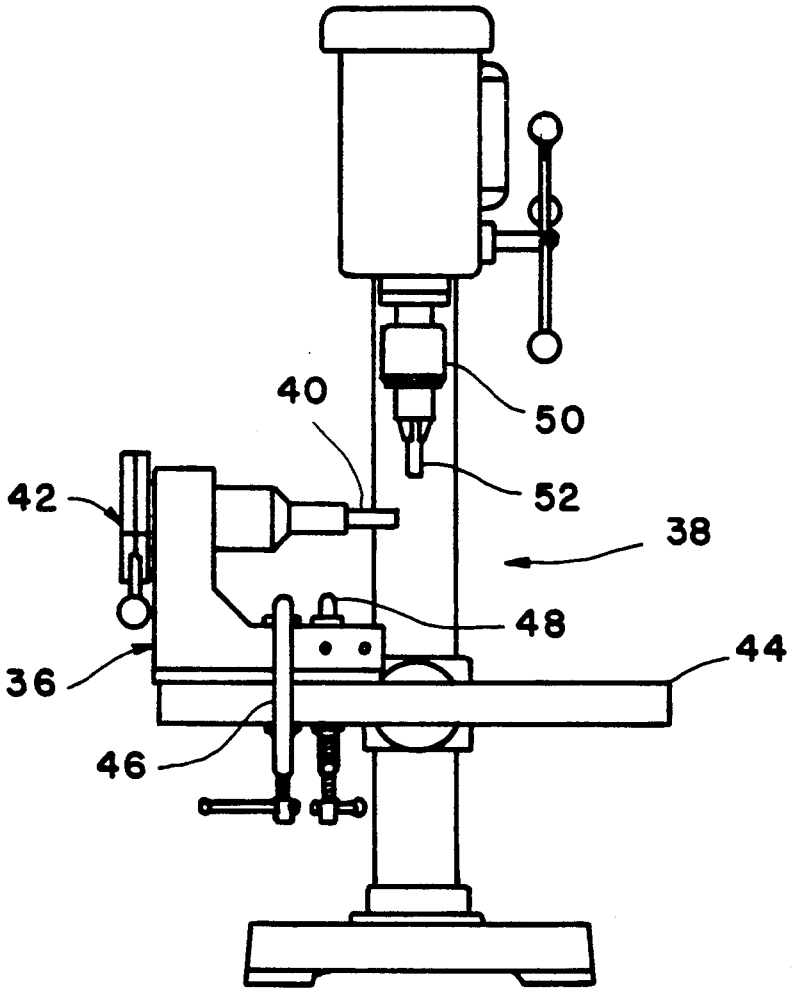
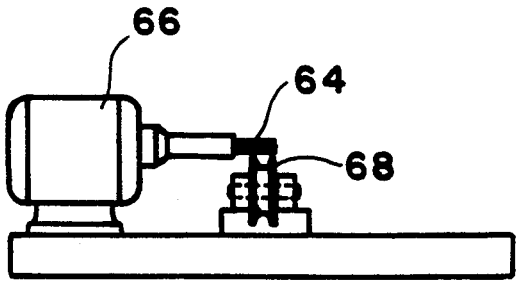
FIG. 11

METHOD OF MAKING A CHANNEL SET RING

BACKGROUND OF THE INVENTION

1. Field of the Invention

The present invention relates generally to the art of making jewelry and, more specifically, to a channel set ring and method of making same in which precise positioning of multiple gems is achieved.

2. Description of the Related Art

Currently known methods of making a channel set ring including forming an annular groove in the outer sidewall of the ring, placing the gems side-by-side in the groove, and then rolling rims upstanding on opposite sides of the gems so that the upper end portions of the rims bend inwardly over the gems and thereby hold them in place.

A problem arises in such a method in that it is critical for the gems, such as diamonds, to be precisely aligned, and the alignment must be maintained during the rim rolling step so that when the ring is finished, the proper setting is achieved.

In one particular method using a groove formed in a ring mounting, the groove is rectangularly shaped and a plurality of holes are formed in the base of the groove, each hole receiving the pavilion of one of a plurality of gems. After placing the gems in the corresponding holes, the rim portions are turned in order to toe the rims inwardly, thus holding the gems in place.

A problem associated with the aforementioned method is that it is difficult to position the holes at the prescribed equidistantly spaced intervals. Furthermore, it is difficult to retain the gems in their corresponding holes during the rim turning step.

U.S. Pat. No. 4,566,294 provides a gem mounting method, in which holes in the groove are avoided entirely by providing the groove with a specific angular shape which is specifically designed to be more acute than the angle of the gems.

SUMMARY OF THE INVENTION

An object of the present invention is to provide a channel set ring in which the gems are set precisely and accurately.

Another object of the present invention is to provide a channel set ring which is relatively inexpensive to manufacture.

Another object of the present invention is to provide a method of making a channel set ring in which the gems are prevented from movement during the rim turning step, thereby ensuring proper positioning of the gems.

Another object of the present invention is to provide a method of making a channel set ring in which setting holes are precisely located.

These and other objects of the invention are met by providing a channel set ring which includes a ring mounting member having an outer cylindrical surface and a circumference, a groove formed in the outer cylindrical surface of the ring mounting member and extending at least partially around the circumference thereof, the groove having a bottom and defining a pair of upstanding rims, each having an upper end surface, a plurality of substantially equidistantly spaced depressions having substantially coplanar axes formed in the bottom of the groove, a setting hole formed centrally in each of the plurality of depressions and having a radius smaller than a radius of the depressions, each setting hole receiving a pavilion of a gem to be set, a sheet of adhesive material in contact with a crown portion of each gem set in the setting holes and the upper end surfaces of the pair of rims, the sheet of adhesive material being removable after toeing the pair of rims inwardly, whereby the gems are held in place during toeing by the removable sheet of adhesive material.

In another aspect of the invention, a method of making a channel set ring include the steps of forming a ring mounting member having a circumference and an outer cylindrical surface, forming a groove in the outer cylindrical surface of the ring mounting member, the groove extending at least partially around the circumference of the ring mounting member, the groove defining a pair of upstanding rims, each having an upper end surface, machining a plurality of equidistantly spaced depressions in the bottom of the groove, drilling a setting hole centrally in each depression, each setting hole having a radius smaller than a radius of the depressions, placing a pavilion of a gem in each of the setting holes to obtain a desired orientation of the gems, placing a sheet of adhesive material in contact with a crown portion of the gems set in the setting holes and the upper end surfaces of the pair of rims, rotating the ring mounting member with the gems held in place by the sheet of adhesive material, rolling the pair of rims to cause the rims to toe inwardly, and machining the outer cylindrical surface of the ring to provide a finished surface.

These and other features and advantages of the channel set ring and method for making same according to the present invention will become more apparent with reference to the following detailed description and drawings.

BRIEF DESCRIPTION OF THE DRAWINGS

FIG. 1 is a perspective view of a ring mounting member prior to the formation steps performed according to the present invention;

FIG. 2 is a perspective view showing the ring mounting member of FIG. 1 after formation of a groove in the outer surface thereof;

FIG. 3A is a perspective view of the ring mounting member after formation of a plurality of indentations in the bottom of the groove;

FIG. 3B is a cross-sectional view taken along line B—B of FIG. 3A;

FIG. 3C is a detailed top view showing one of the depressions of FIG. 3A;

FIG. 4 is a cross-sectional view similar to FIG. 3, after drilling a plurality of setting holes;

FIG. 5 is an enlarged view of a portion of FIG. 4, after performing a polishing step according to the present invention;

FIG. 6 is an enlarged cross-sectional view similar to FIG. 5, showing the mounting holes filled with wax;

FIG. 7 is an enlarged cross-sectional view similar to FIG. 6 showing the application of a sheet of adhesive material over gems set in the setting holes;

FIG. 8 is a perspective, partially cut away, showing the ring mounting member after rolling rim portions inwardly;

FIG. 9 is a perspective view, partially in section, illustrating the ring mounting member after finishing the exterior surface;

FIG. 10 is a side elevational view showing an apparatus for forming the depressions and mounting holes; and FIG. 11 is a side elevational view of an apparatus for rolling the rim portions of the ring mounting member inwardly.

DETAILED DESCRIPTION OF THE PREFERRED EMBODIMENTS

FIGS. 1 through 9 show the sequential steps undertaken according to the method of the present invention. In FIG. 1, a ring mounting member is generally referred to by the numeral 20 and has an outer cylindrical surface 22 extending circumferentially around the longitudinal axis of the ring mounting member 20. The ring mounting member 20 is preferably made by die striking, which is a stamping process.

As shown in FIG. 2, a groove 24 is formed in the outer cylindrical surface 22 of the ring mounting member 20 and extends at least partially around the circumference of the ring mounting member 20. The groove 24 is preferably U-shaped and defines a pair of upstanding rims 26 and 28. Each rim has an upper end surface 30 and 32 corresponding to the cylindrical outer surface 22 of the blank ring mounting member 20 prior to cutting the groove. The groove 24 is cut by a standard Swiss-cut machine, which is commercially available and well known.

As shown in FIG. 3A, a plurality of substantially equidistantly spaced depressions 34 are formed in the bottom of the groove 24 of the ring mounting member 20. The depressions 34 have substantially coplanar axes formed in the bottom of the groove 24. A device for forming the depressions is illustrated in FIG. 10.

Referring to FIG. 10, a divider 36 is mounted on a drill press machine 38. Both machines are commercially available, but not in combination. The divider 36 is available from Gold Industrial Machinery of Rhode Island and includes a ring mounting portion 40 and an indexing mechanism 42 which is used to turn the ring mounting portion 40 at selectable, angular increments. The divider 36 is mounted to a stationary platform 44 of a drill press machine 38 by means of clamps 46 and 48.

The drill press machine 38 has a spindle 50 and chuck 52 for turning a drill bit (not shown). A typical drill bit has a short conical end and a helical cutting sidewall. The diameter of the sidewall determines the diameter of the hole drilled by the bit. However, according to the present invention, a relatively large drill bit such as one having a sidewall diameter extending the distance between one rim 30 to the other 32, is used to make a partial hole. In other words, the drill bit is lowered into the direction of the ring mounted on the divider 36, but the boring stroke of the drill is shortened so that the depressions 34 are formed instead of holes. The depressions 34 have a relatively complex geometry and appear to be elongated in a direction parallel to the axis of the ring mounting member 20. At the center of each depression is a conical portion corresponding to the pointed end of the drill bit. This conical portion is illustrated in FIG. 3C and is referred by the reference numeral 34c.

After forming the depressions 34, the relatively large diameter drill bit is replaced by a smaller one which is used to form the holes 54 shown in FIG. 4. Although the holes 54 may be formed by the drill press machine shown in FIG. 10, using a smaller drill bit, the holes may also be formed by a burr-machine which is commercially available. Having formed the depressions 34, it is now easier to form the holes 54 precisely.

FIG. 5 illustrates the next step of the process, in which the groove 24 is polished by a conventional polishing machine to provide a shiny surface under the gems so as to enhance their appearance.

FIG. 6 illustrates the next step of the process, in which the depressions and holes are filled with wax 56. The wax 56 holds the diamonds in place when they are initially placed on the ring mounting member 20. Although the wax step is optional, it is helpful in placing the gems, preferably diamonds, in the channel 24 in a non-abutting (with each other) position. The wax is eventually removed by melting prior to the polishing step (to be described later).

As shown in FIG. 7, the diamonds 58 are placed with their pavilions or apex in the holes 54. Then, a piece of adhesive material, such as removable pressure sensitive tape 60 is applied to the upper end surfaces of the pair of rims and adhesively contacts the crown portions 62 of each of the gems or diamonds 58 so as to secure the diamonds in place during subsequent processing steps.

In the subsequent processing steps, as illustrated in FIG. 11, the ring is placed on the spindle 64 of a lathe which includes a motor 66 for rotating the spindle at a relatively high speed (hundreds of rpms).

Once the ring (not shown in FIG. 11) is caused to rotate by the motor 66, a roller 68 which is rotatably mounted is caused to translate towards the ring. Since the roller 68 has a double flange, opposed U-shape in cross-section, the rims of the ring mounting portion are pushed inwardly to create a toeing in of the rims, whereupon the rims grasp the girdle of the diamonds and firmly hold them in place. This process step is called rolling the rims, and creates a form illustrated in FIG. 8, in which the soft metal which comprises the ring mounting portion 20 is worked inwardly and upwardly. Thus, although after rolling, the diamonds 58 are held firmly in place, a pair of lips 70 and 72 are formed at the top of the rims 30 and 32. These lips are removed in a final machining or polishing step as illustrated in FIG. 9, in which the outer surface of the ring mounting portion 20 is smoothly contoured to a desired shape.

Prior to the final polishing or machining step described above, the tape 60 is peeled off and removed, having successfully served the purpose of holding the diamonds in place while rotating the ring on the lathe.

Numerous modifications and adaptations of the present invention will be apparent to those so skilled in the art and thus it is intended by the following claims to cover all such modifications and adaptations which fall within the true spirit and scope of the invention.

What is claimed:

1. A method of making set ring comprising the steps of:

(a) forming a ring member having an outer cylindrical surface;

(b) forming a groove in the outer cylindrical surface of the ring mounting member, the groove extending at least partially around the circumference of the ring mounting member, and the groove defining a pair of upstanding rims, each having an upper end surface;

(c) machining a plurality of equidistantly spaced depressions in the bottom of the groove;

(d) drilling a setting hole centrally in each depression;

(e) placing a gem in each of the setting holes to obtain a desired orientation of the gems;

(f) applying a sheet of adhesive material to the upper end surfaces of the pair of upstanding rims and to a crown portion of the gems to the thereby hold the gems in place;

(g) rotating the ring mounting member while pressing a roller against the pair of rims, thereby toeing the rims inwardly into engagement with the gems;

(h) removing the sheet of adhesive material; and (i) polishing the ring mounting member to form a desired final shape.

2. A method of making a channel set ring according to claim 1, further comprising, prior to step (e), filling the depressions and setting holes with wax, and subsequently removing the wax by heating prior to step (g).

3. A method of making a channel set ring according to claim 1, further comprising, prior to step (e) polishing the groove to form a lustrous surface.

4. A method of making a channel set ring according to claim 1, wherein step (c) comprises drilling a shallow depression with a relatively large diameter drill bit whose diameter is substantially the same as the width between the upstanding rims, the shallow depression having a central conically shaped portion centered between the upstanding rims.

5. A method of making a channel set ring according to claim 1, wherein the groove is substantially U-shaped in cross-section.

6. A method of making a channel set ring according to claim 5, wherein the drill bit used for drilling the plurality of depressions has a diameter substantially corresponding to the width between the pair of upstanding rims.

7. A method of making a channel set ring according to claim 1, wherein step (c) comprises drilling a shallow depression in the groove at equidistantly spaced intervals, wherein a pointed end of a drill bit used for drilling the depressions forms a conical portion of the depressions which is used to center a smaller diameter drill bit used when drilling the setting holes of step (d).

* * * * *